United States Patent [19]

Suzuki

[11] 4,379,630

[45] Apr. 12, 1983

[54] TRANSFER ROLLER FOR ELECTROPHOTOGRAPHIC APPARATUS

[75] Inventor: Yoshiro Suzuki, Hachioji, Japan

[73] Assignee: Olympus Optical Company Limited, Tokyo, Japan

[21] Appl. No.: 248,279

[22] Filed: Mar. 27, 1981

[30] Foreign Application Priority Data

Apr. 1, 1980 [JP] Japan ..... 55-41158
Aug. 29, 1980 [JP] Japan ..... 55-122935[U]

[51] Int. Cl.[3] ..... G03G 15/16

[52] U.S. Cl. ..... 355/3 TR; 355/14 TR; 361/225

[58] Field of Search ..... 355/3 TR, 14 TR, 3 TE, 355/3 CH; 430/126; 361/221, 225

[56] References Cited

U.S. PATENT DOCUMENTS 3,778,690 12/1973 Rothacker et al. ..... 361/235 X
3,924,943 12/1975 Fletcher ..... 355/3 TR
3,942,888 3/1976 Maksymiak et al. ..... 355/3 TR
4,049,343 9/1977 Hermanson ..... 361/221 X
4,309,737 1/1982 Tolmie, Jr. ..... 355/3 CH

*Primary Examiner*—A. D. Pellinen
*Assistant Examiner*—Keith E. George
*Attorney, Agent, or Firm*—Fleit, Jacobson & Cohn

[57] ABSTRACT

A transfer roller for electrophotographic apparatus for transferring a toner image formed on a latent image electric charge holding body to a record sheet by making the record sheet close contact with the latent image electric charge holding body, comprising an electrically conductive roller shaft connected to a transfer bias electric source and operative to apply a given transfer bias voltage between the roller shaft and the latent image electric charge holding body and an electrically conductive resilient member coated around the outer periphery of the electrically conductive roller shaft and having a resistance value which is increased in a continuous or stepwise manner toward the respective end faces at two end portions of the electrically conductive resilient member.

16 Claims, 12 Drawing Figures

TRANSFER ROLLER FOR ELECTROPHOTOGRAPHIC APPARATUS

BACKGROUND OF THE INVENTION

Field of the Invention

This invention relates to transfer rollers for electrophotographic apparatus and more particularly to a transfer roller for electrophotographic apparatus which can repeat development and transfer with respect to an electrostatic latent image which has been produced on a latent image charge holding body and which can obtain a plurality of copies.

Heretofore, it has been the common practice to use an electrophotographic apparatus that can obtain one copy from an electrostatic latent image which has been produced on a latent image electric charge holding body such as a photosensor. Electrophotographic apparatus of this type, hereinafter called single-copy electrophotographic apparatus, generally makes use of a transfer device based on a corona discharge transfer system or bias roller transfer system.

Meanwhile, an electrophotographic apparatus has heretofore been proposed which can repeat development and transfer with respect to an electrostatic latent image which has been formed on a latent image electric charge holding body to obtain a plurality of copies. Electrophotographic apparatus of this type hereinafter called multiple-copy electrophotographic apparatus, preferably uses a transfer device based on the bias roller transfer system rather than that based on the corona discharge transfer system. The use of the transfer device based on the bias roller transfer system ensures a slight disturbance of the electrostatic latent image when the record sheet makes contact with and is separated from the latent image electric charge holding body. Nevertheless, it is difficult to bring the record sheet into close contact with the latent image electric charge holding body, thereby inducing a transfer failure. In order to eliminate such drawback, the transfer bias voltage must be made high. When the transfer bias voltage is made high in order to improve the transfer efficiency, the single-copy electrophotographic apparatus operates without problem, but the multiple-copy electrophotographic apparatus has the drawback that, after a single occurrence of the following phenomenon, all of succeeding copies deteriorate. That is, if the transfer bias voltage is made high, the electric charge injected from the transfer roller through the record sheet into the latent image electric charge holding body is increased and accumulated on the surface of the latent image electric charge holding body. This injection electric charge is repeatedly produced in succession at every transfer during the step of obtaining a plurality of copies and does not exert any adverse influence upon the quality of the picture image during the first step of obtaining 2 to 3 copies. But, in the case of obtaining a large number of copies such as 5 to 10, particularly 20 to several tens of copies, the accumulation of the injection electric charge is gradually increased.

At the time of development, the toner is adhered to the injection electric charge and then, during the transfer step, the toner is transferred to the record sheet. As a result, contamination of the record sheet due to the toner gradually increases. This phenomenon will hereinafter be called as a multiple-copy fog phenomenon. Thus, it is impossible to obtain a large number of copies having good quality. The higher the transfer bias voltage the more conspicuous this phenomenon. If the transfer bias voltage is further increased, a discharge phenomenon occurs when the record sheet is peeled off the latent image electric charge holding body. As a result, a troublesome electric charge is generated due to the discharge in the background within the region of the picture image of the latent image electric charge holding body and this electric charge is developed, thereby obtaining unusable, dirty copies only. As the number of transfers is increased, the electric charge due to the discharge is accumulated so that it is impossible to obtain copies which are suitable for practical use. In order to remove the undesired electric charge due to the discharge, all of the surface of the latent image electric charge holding body may be exposed to light during the step of obtaining a plurality of copies. But, in this case, it is impossible to obtain any subsequent copies unless the electrostatic latent image is produced again.

If the transfer bias voltage is further increased, the discharge becomes considerably large when the record sheet is peeled off the latent image electric charge holding body. As a result, the toner image transferred to the record sheet is disturbed, the toner image on the latent image electric charge holding body is disturbed prior to its transfer to the record sheet or the electrostatic latent image is disturbed, thereby deteriorating the latent image electric charge holding body per se in itself.

In the single-copy electrophotographic photographic apparatus, the upper limit of the transfer bias voltage that is applicable to the transfer roller is defined by a voltage value at which the toner image is disturbed due to the above mentioned discharge phenomenon. In the multiple-copy electrophotographic apparatus, the upper limit of the transfer bias voltage that is applicable to the transfer roller is defined by a voltage value at which the above mentioned multiple-copy fog phenomenon occurs. This voltage value is far lower than the voltage value at which the above mentioned discharge phenomenon occurs. As a result, the conventional transfer roller has the drawback that its transfer efficiency is bad and that a plurality of copies cannot be obtained at a high speed.

SUMMARY OF THE INVENTION

An object of the invention, therefore, is to provide a transfer roller which, when it is applied to an electrophotographic apparatus for obtaining a plurality of copies, can effectively prevent the above mentioned mulitple-copy fog phenomenon and which can obtain a plurality of copies having excellent picture quality with a high transfer efficiency at a high speed.

A feature of the invention is the provision, in a transfer roller for electrophotographic apparatus for transferring a toner image formed on a latent image electric charge holding body to a record sheet by making the record sheet closely contact the latent image electric charge holding body for an electrically conductive roller shaft connected to a transfer bias electric source and operative to apply a given transfer bias voltage between the roller shaft and the latent image electric charge holding body and an electrically conductive resilient member coated around the outer periphery of the electrically conductive roller shaft and having a resistance value which is increased in a continuous or stepwise manner toward the respective end faces at two end portions of the electrically conductive resilient member.

Further objects and features of the invention will be fully understood from the following detailed description with reference to the accompanying drawings, wherein:

DETAILED DESCRIPTION OF THE PREFERRED EMBODIMENTS

Figure 1:
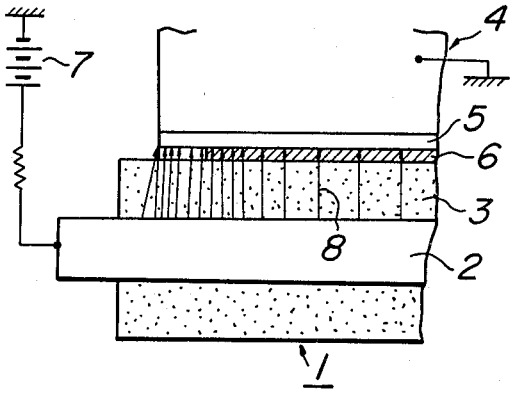
FIG. 1 PRIOR ART
FIG. 1 is a diagrammatic cross-sectional view of one example of a conventional transfer roller.

FIG. 1 shows one example of a conventional transfer roller. The transfer roller 1 shown in FIG. 1 is composed of an electrically conductive cylindrical shaft 2 and at least one electrically conductive rubber layer 3 coated around the outer periphery of the cylindrical shaft 2 and formed by a substance obtained by a uniformly dispersing electrically conductive powders, for example, carbon powders, metal powders into nitrile rubber, ethylene propylene rubber, fluorine rubber, polyurethane rubber, silicone rubber or the like. The surface of the electrically conductive layer 3 may be coated with a thin film layer having an excellent mold releasing property and extremely small frictional coefficient and formed by fluorine resin such as Teflon or the like or polyurethane. The electrically conductive rubber layer 3 is uniform in quality and has a uniform resistance value in the axial direction thereof.

The transfer roller 1 may be used to transfer a toner image formed on a photosensitive layer 5 of a photosensitive body 4, for example, to a record sheet 6. In this case, the record sheet 6 closely contact the photosensitive body 4 by means of the transfer roller 1, and a voltage whose polarity is opposite to that of the electric charge of the toner image is supplied from a bias electric source 7 to the cylindrical shaft 2 of the transfer roller 1. As a result, the toner image on the photosensitive body 4 is electrostatically absorbed onto the record sheet 6, thereby transferring the toner image onto the record sheet. It has been the common practice to make the resistance value of the electrically conductive rubber layer 3 of the transfer roller 1 $10^5$ to $10^{12}$ [ohms] and use a high bias voltage of 1 kv to 3 kv.

The application of such conventional transfer roller 1 to an electrophotographic apparatus for obtaining a plurality of copies results in generation of the above mentioned multiple-copy fog phenomenon. In order to supress such multiple-copy fog phenomenon, it is necessary to decrease the transfer bias voltage. It has been considered that the multiple-copy fog phenomenon occurs due to current 8 supplied from the transfer roller 1 through the record sheet 6 to the photosensitive body 4. In addition, a plurality of copying operations have demonstrated (1) that the multiple-copy fog phenomenon is concentrated into two end portions of the record sheet 6 rather than its center portion, (2) that as the number of copies is increased the fog is gradually shifted toward the center portion of the record sheet 6, and (3) that the electric charge injected from the transfer roller 1 into the record sheet 6 is increased at the two end portions thereof as shown in FIG. 1. The lower the resistance value of the transfer roller 1 the more conspicuous the fog phenomenon, the higher the transfer bias voltage the more conspicuous the fog phenomenon, the lower the resistance value of the record sheet the more conspicuous the fog phenomenon, and the thinner the thickness of the record sheet 6 the more conspicuous the fog phenomenon.

Figure 2:
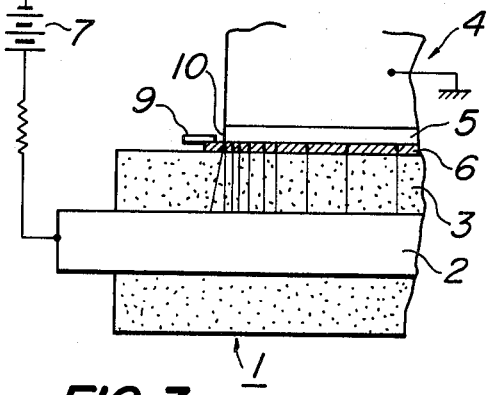
FIG. 2 PRIOR ART
FIG. 2 is a diagrammatic cross-sectional view of another example of a conventional transfer roller.

FIG. 2 shows another example of a conventional transfer roller. In the example shown in FIG. 2, use is made of the transfer roller shown in FIG. 1 and the end face of the photosensitive body 4 is arranged inside the end face of the record sheet 6. In the present example, in order to peel off the record sheet 6 from the photosensitive body 4 after the transfer has been effected, provision is made for a peeling claw 9 near the end face of the photosensitive body 4. In the present example, the electric charge is injected from the transfer roller 1 into the record sheet 6 and concentrated into the edge portion 10 of the photosensitive body 4. In the present example, the multiple-copy fog phenomenon is more conspicuous than that produced in the example shown in FIG. 1. In addition, a multiple-copy edge line phenomenon is produced which is more conspicuous than the fog phenomenon. That is, the injection electric charge is concentrated into the edge portion 10 of the photosensitive body 4, so that development and transfer are repeated at the edge portion 10 during the step of obtaining a plurality of copies. As a result, a great amount of toner adheres to the edge portion 10 at the development step. As a result, considerable, line-like contamination aligned with the edge portion 10 of the photosensitive body 4 is produced at the two end portions of the record sheet 6. The above mentioned multiple-copy fog phenomenon and multiple-copy edge line phenomenon are not produced in an electrophotographic apparatus for obtaining one copy, but are produced in and inherent to electrophotographic apparatus for obtaining a plurality of copies.

Figure 3:
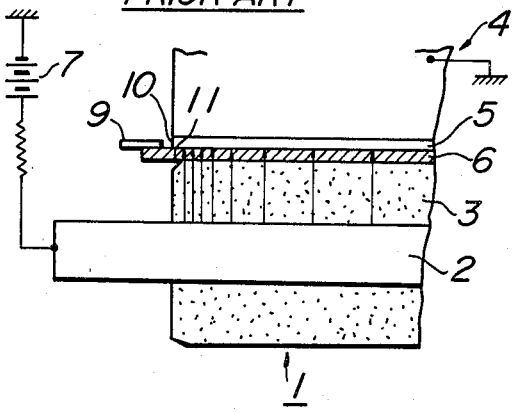
FIG. 3 PRIOR ART
FIG. 3 is a diagrammatic cross-sectional view of a further example of a conventional transfer roller.

FIG. 3 shows a further example of a conventional transfer roller. In the example shown in FIG. 3, the positional relation between the end face of the transfer roller 1 and the end face of the photosensitive body 4 is selected such that the multiple-copy edge line phenomenon described with reference to FIG. 2 can be prevented. That is, the mulitple-copy edge line phenomenon is prevented by locating the end face 11 of the electrically conductive rubber layer 3 of the transfer roller 1 at a position inside the end face 10 of at least photosensitive body 4. In addition, the multiple-copy edge line phenomenon can effectively be prevented by planing off the corner of the end face 11 of the electrically conductive rubber layer 3. In the edge portion 10 of the photosensitive body 4, the photosensitive layer 5 becomes thinner, is subjected to damage or the like to expose the electrically conductive portion in the rear thereof, and as a result, the electric charge is highly concentrated at the thinned or damaged portion, thereby accumulating a large amount of electric charge in the photosensitive layer 5 near the thinned or damaged portion. Such phenomenon functions to suppress the injection electric charge from concentrating into the edge portion by arranging the end face 11 inside the edge of the photosensitive body 4 and making the edge of the photosensitive body 4 free from the end face 11. The distribution of the injection electric charge tends to be concentrated at the two end portions of the record sheet 6. It is impossible to theoretically prevent such distribution of the injection electric charge. The multiple-copy fog tends to be increased at the two end portions of the record sheet 6 in place of the multiple-copy edge line. Conversely, if the transfer roller 1 is arranged as shown in FIG. 2, a considerably large number of multiple-copy edge lines are produced and the rate of producing the multiple-copy fog at the two end portions of the record sheet 6 tends to decrease. Experimental tests have shown that the higher the transfer bias voltage the more conspicuous the above mentioned phenomenon. As a result, the relative arrangement between the photosensitive body 4 and the transfer roller can prevent the multiple-copy edge line, but could not simultaneously prevent the multiple-copy fog.

In the present invention, the transfer roller is constructed taking into account the above mentioned phenomenon such that the injection electric charge is prevented from being locally concentrated, which causes the generation of the above mentioned phenomenon, without using the conventional electrically conductive rubber whose electrical conductivity is uniform in the axial direction thereof. More particularly, the electrical resistance at the two end portions in the axial direction of the transfer roller is continously or intermittently changed at a rate which is higher than that of the electrical resistance at the least center portion thereof. The use of such measure ensures a uniform distribution in the axial direction of the electric charge injected from the transfer roller through the record sheet into a latent image electric charge holding body, such as the photosensitive body or the like, and provides the important advantages that both the multiple-copy fog phenomenon and the multiple-copy edge line phenomenon can be suppressed, and that the worese condition of reducing the transfer bias voltage, and hence the transfer efficiency, can be eliminated, thereby obtaining a plurality of copies at a high speed with a high transfer efficiency.

Figure 4:
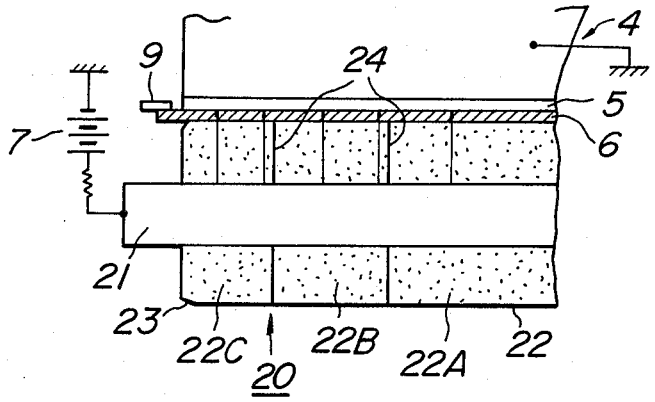
FIG. 4 is a diagrammatic cross-sectional view of one embodiment of a transfer roller according to the invention.

FIG. 4 shows one embodiment of a transfer roller according to the invention. A transfer roller 20 shown in FIG. 4 is composed of an electrically conductive roller shaft 21 which is substantially uniform in diameter and an electrically conductive resilient member 22 coated around the shaft 21 and formed by substances which are similar to those described with reference to FIG. 1. In the present embodiment, the composition of the electrically conductive resilient member 22 is selected such that the resistance value of the member 22 becomes high in a stepwise manner in succession from its center portion 22A to its end face portions 22B, 22C. In addition, the axial length of the member 22 is made substantially equal to or somewhat shorter than the length of the latent image electric charge holding body or photosensitive body 4. The edge 23 of the end portion 22 is beveled. In the present embodiment, the same reference numerals as those shown in FIGS. 1 to 3 designate the same parts. Experimental tests show that it is effective to make the resistance value at the end face portion 22C 3 to 10 times higher than that at the center portion 22A. There is a risk of irregular transfers being produced at boundary portions 24 between adjacent portions. In practice, however, the transfer electric field at each boundary portion exerts its effect over a distance of 1 mm to 2 mm in the axial direction, so that no practical irregular transfer occurs.

In the case of manufacturing the electrically conductive resilient member 22 by mold forming, rubber substances of different resistant values may be poured into the outer portion and end face portions of the member 22, respectively, to obtain a transfer roller whose resistance value is continuously changed.

Figure 5A:
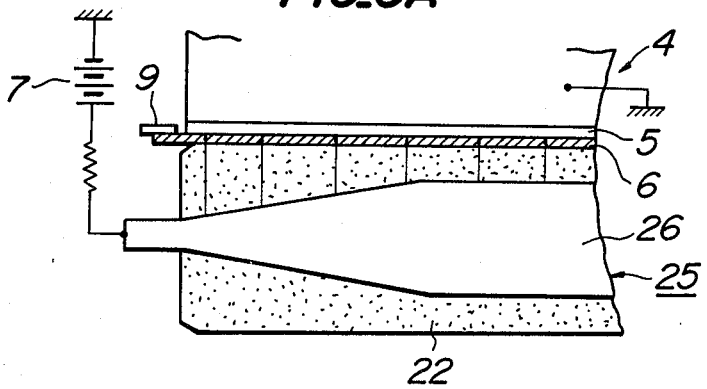
FIG. 5A is a diagrammatic cross-sectional view of another embodiment of a transfer roller according to the invention.
Figure 5B:
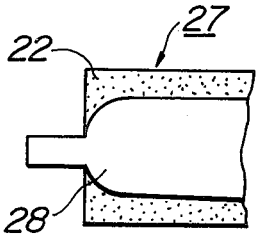
FIG. 5B is a diagrammatic cross-sectional view of a further embodiment of a transfer roller according to the invention.
Figure 5C:
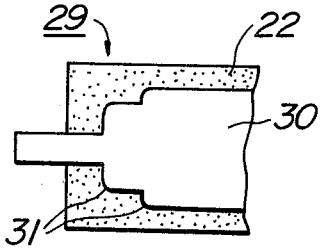
FIG. 5C is a diagrammatic cross-sectional view of a still further embodiment of a transfer roller according to the invention.

FIGS. 5A, 5B and 5C show three alternative embodiments of a transfer roller according to the invention. In the embodiments shown in FIGS. 5A, 5B and 5C, the composition of the electrically conductive resilient member is not changed so as to change its resistance value. The electrically conductive resilient member 22 is formed by a substance having the same composition but the configuration of the electrically conductive roller shaft is changed such that the resistance value at the end face portion of the electrically conductive resilient member 22 is continuously or intermittently made higher toward the end face thereof. That is, the resistance value of the electrically conductive resilient member 22 increases as the thickness thereof is increased. In the transfer roller 25 shown in FIG. 5A, the end portion of the electrically conductive roller 27 shown in FIG. 5B, the end portion of the electrically conductive roller shaft 28 is reduced in diameter by curved end faces. In the transfer roller 29 shown in FIG. 5C, the end portion the electrically conductive roller 30 is reduced in diameter in a stepwise manner. In the transfer roller 39 shown in FIG. 5C, the resistance value of the electrically conductive resilient member 22 increases toward the end surface in a stepwise manner. In the case of forming the electrically conductive roller shaft 30 in a stepwise manner as to suddenly change its diameter, it is preferable to plane off the edge portions 31 formed between the adjacent edges.

Figure 6:
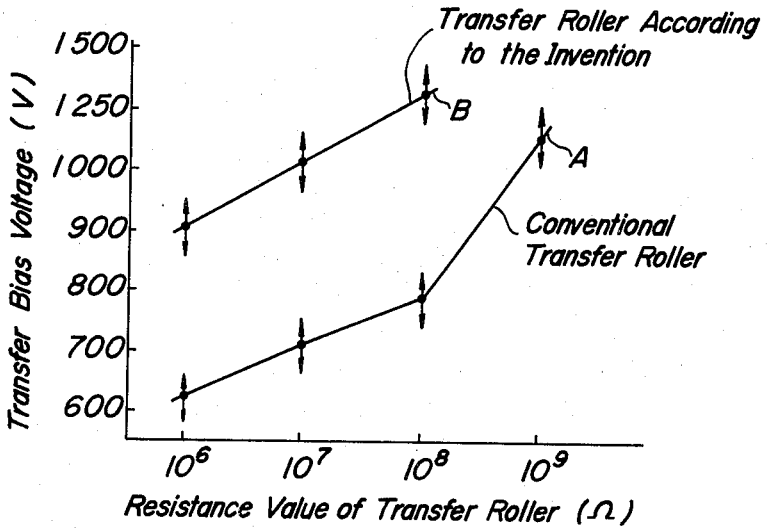
FIG. 6 is a graph illustrating the resistance value transfer bias voltage value characteristic of a conventional roller as compared with that of a transfer roller according to the invention, the transfer rollers being applied to an electrophotographic apparatus for obtaining a plurality of copies.

FIG. 6 shows a graph illustrating experimental tests results on a conventional transfer roller and the transfer roller according to the invention. In FIG. 6, the resistance value of the transfer roller is taken on the abscissa and the transfer bias voltage is taken on the ordinate. A full line curve A was obtained from the conventional transfer roller, while a full line curve B was obtained from the transfer roller according to the invention in which the resistance value at the end portion was made the values of the abscissa shown in FIG. 6, while the resistance value at two end portions was made at least three times higher than that of the center portion.

In both the conventional transfer roller and the transfer roller according to the invention, the development and transfer were repeated on one latent image to obtain a plurality of copies. Prior to the 20th copy in the plurality of continuous copying steps, multiple-copy fog and edge line occured. The relationship between the resistance value of the transfer roller and the transfer bias voltage value is shown in FIG. 6.

The resistance value of the transfer roller was measured as follows. An aluminum electrode plate having a width of 100 mm and a flat surface was disposed on a V-shaped block and bent into a V-shaped electrode plate, which was then grounded. On the V-shaped electrode plate was disposed the transfer roller whose electrically conductive roller shaft was subjected at its two ends to 500 g of load in the downward direction. Between the roller shaft and the aluminum electrode plate was applied a direct current voltage of 100 V, thereby measuring the current flowing from the roller shaft to the aluminum electrode plate.

The comparative measurement of the resistance value between the center portion and the end portions of the transfer roller according to the present invention was effected in the same manner as the above mentioned comparative measurement by using an aluminum electrode plate having a width of 10 mm.

The full line curve B shown in FIG. 6 is not suitably called as bias voltage curve at which multiple-copy fog phenomenon and multiple-copy edge line phenomenon are produced, but is obtained by contamination due to discharge phenomenon produced when the record sheet is peeled off the photosensitive body after the toner image has been transferred to the record sheet. The multiple-copy contamination phenomenon is not changed and hence is shown by the bias voltage value.

Concerning this discharge phenomenon, in the case of obtaining one copy, the boundary voltage value influential to the picture image takes a voltage value which is higher than the voltage value shown by the full line curve B. In this case, the discharge phenomenon causes the toner image to be transferred to the record sheet to be disturbed. In practice, however, the disturbance of the toner image is not observed when one copy is obtained under the condition of the full line curve B and hence offers no problem.

As stated hereinbefore, when the transfer roller according to the invention is used for an electrophotographic apparatus for obtaining a plurality of copies, it is possible to apply a bias voltage which is substantially the same value as that which can be applied to an electrophotographic apparatus for obtaining one copy. It is possible to apply a transfer bias voltage which is far higher than that applicable to the conventional transfer roller and shown by the full line curve A in FIG. 6. As a result, the transfer roller according to the invention is capable of obtaining a copy having an excellent picture quality at a high speed with a high transfer efficiency without inducing any multiple-copy fog or multiple-copy edge line phenomenon.

Figure 7A:
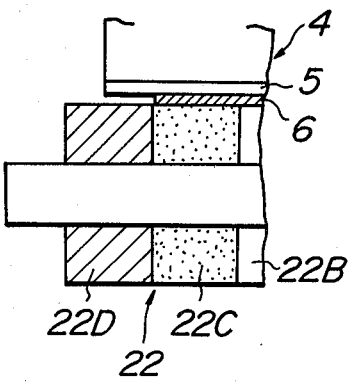
FIG. 7A is a partial cross-sectional view of another embodiment of a transfer roller according to the invention.
Figure 7B:
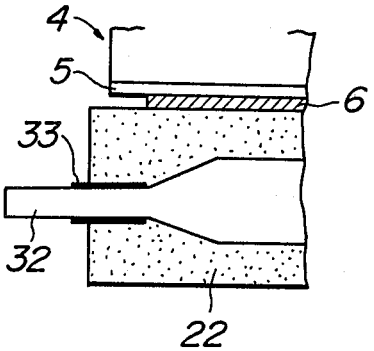
FIG. 7B is a partial cross-sectional view of another embodiment of a transfer roller according to the invention.

As shown in FIGS. 3, 4 and 5, it is preferable to locate the end face of the electrically conductive resilient member at a position which is inside the end face of the latent image holding body, such as the photosensitive body or the like. However, sufficiently advantageous results can also be obtained even when the electrically conductive resilient member is made longer than the latent image holding body as shown in FIGS. 1 and 2. FIG. 7A and 7B illustrate such embodiments. In FIG. 7A the electrically conductive resilient member 22 is composed of a plurality of portions 22B, 22C, 22D having different resistance values like the embodiment shown in FIG. 4. In this case it is preferable to make the resistance value of that end portion 22D of the electrically conductive resilient member 22 which does not make contact with the record sheet 6 higher than $10^{12}$ [ohms]. In the embodiment shown in FIG. 7B, the electrically conductive resilient member 22 is formed as a single body and the electrically conductive roller shaft 32 is changed in configuration to change its resistance value. In this case, it is preferable to interpose a ring 33 having a high insulation property between the edge portion of the electrically conductive resilient member 22 and that reduced diameter portion of the electrically conductive roller shaft 32 which does not correspond to the record sheet 6 or which corresponds to the edge portion of the record sheet 6. Alternatively, the transfer roller according to the present invention may be constructed by a combination of the embodiments shown in FIGS. 4, 5 and 7. In addition, the use of transfer roller according to the invention ensures a uniform transfer electric field in the axial direction thereof. As a result, it is a matter of course that the transfer roller according to the invention may also effectively be applied to single-copy electrophotographic apparatus.

Figure 8:
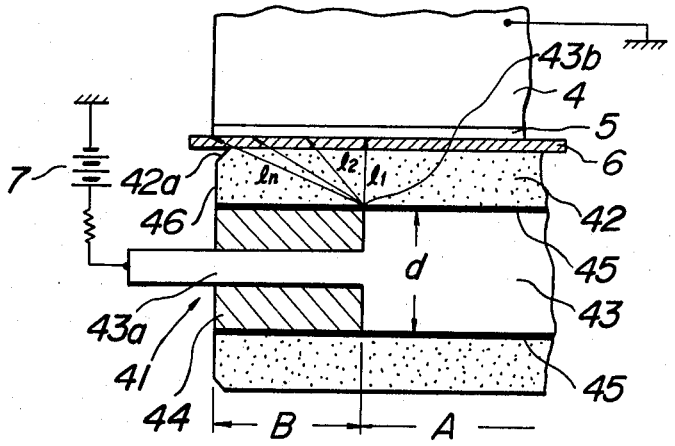
FIG. 8 is a diagrammatic cross-sectional view of another embodiment of a transfer roller according to the invention.

FIG. 8 shows another embodiment of a transfer roller to the invention. As shown in FIG. 8, a record sheet 6 closely contacts a latent image electric charge holding body 5 formed on the surface of a photosensitive body 4. A transfer roller 41 is connected through an electrically conductive roller shaft 43 to a transfer bias voltage supply source 7. A cylindrical insulating member 44 is fitted around two end portions of the electrically conductive roller shaft 54 (one end portion only is shown). The end portion of the electrically conductive roller shaft 43 is composed of a reduced diameter portion 43*a*, and the outer diameter of the cylindrical insulating member 44 is made equal to the diameter d of the center portion of the electrically conductive roller shaft 43. The cylindrical insulating member 44 may be formed by various kinds of plastics and preferably formed by plastic having an excellent heat resistant property such as silicone resin, epoxy resin, polycarbonate resin, nylon resin, polypropylene resin or the like containing glass fiber. Both the outer periphery of electrically conductive roller shaft 43 and the two end portions with the insulating members 44, are coated with one or more than one layers of an electrically conductive resilient member 42 formed by nitrile rubber, ethylene-propylene rubber, fluorine rubber, polyurethane rubber, silicone rubber, chloroprene rubber or the like containing electrically conductive powders such as carbon powders, metal powders or the like uniformly dispersed therein.

In order to prevent the toner from adhering onto the surface of the electrically conductive resilient member 42, the surface of the electrically conductive resilient member 42 may be coated with a thin film layer formed by fluorine resin, polyurethane resin such as Teflon or the like having an excellent mold releasing property and a very small friction coefficient.

The electrically conductive resilient member 42 coated around the outer periphery of the electrically conductive roller shaft 43 is made uniform in its quality and thickness so as to display a uniform resistance value in the axial direction of the transfer roller 41. A boundary surface 45 formed between the electrically conductive roller shaft 43 and the electrically conductive resilient member 42 is painted with an adhesive agent so as to secure these two members together. As such adhesive agent, use may be made of a synthetic resin such as epoxy resin, polyvinyl chloride resin, polyvinylidene chloride resin, silicone resin, polyurethane resin, polyacetal resin or the like or synthetic rubber, cyclized rubber, chloroprene rubber, styrene rubber or the like. The end corner 42*a* of the electrically conductive resilient member 42 is planed off in order to prevent the edge line phenomenon due to concentration of the electric charge injection.

In the present embodiment, in the case of transferring the toner image produced by the latent image forming step and development step onto the record sheet 6 by means of the transfer roller 41, the transfer roller 41 causes the record sheet 6 to closely contact the latent image electric charge holding body 5 of the photosensitive body 4. Subsequently, a voltage having a polarity which is opposite to that of the electric charge of the toner image is applied from the bias voltage source 7 to the electrically conductive roller 41 so as to electrostatically attract and transfer the toner image on the latent image electric charge holding body 5 onto the record sheet 6. In this case, the electrically conductive resilient member 42 is uniform in quality and thickness in the center region A and end portion region B of the transfer roller 41 in the axial direction of the transfer roller 41, but the presence of the insulating member 44 causes the electrically conductive roller shaft 43 to change its resistance value. That is, in the center region A, the electrically conductive resilient member 42 is uniform in its resistance value and thickness. As a result, the resistance value against the electric charge injected from the electrically conductive roller shaft 43 to the latent image electric charge holding body 5 is uniform. But, in the end portion region B the insulating member 44 is present, which is uniform in quality and thickness, the distance from the end portion 43*b* of the electrically conductive roller shaft 43 to the latent image electric charge holding body 5 is changed to distances $l_1$, $l_2$, . . . In as the latent image electric charge holding body 5 concerned nears the end portion 46 of the transfer roller 41 where the distance becomes maximum. This means that, in the end portion region B, the thickness of the electrically conductive resilient member 42 becomes substantially larger than that of the center portion region A and the composition of the electrically conductive resilient member 42 is changed such that the resistance value of the electrically conductive resilient member 42 is increased toward toward end portion 46 there in succession.

Figure 9:
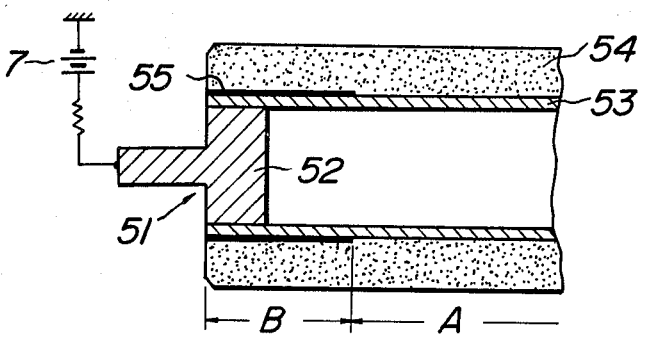
FIG. 9 is a diagrammatic cross-sectional view of another embodiment of a transfer roller according to the invention.

FIG. 9 shows another embodiment of a transfer roller according to the invention. In this embodiment, an electrically conductive roller shaft 52 is fitted in an electrically conductive pipe 53 composed, for example, of an aluminum pipe. That portion of the adhered portion between the electrically conductive pipe 53 and the electrically conductive resilient member 54 which is opposed to the end portion region B of the transfer roller 51 is subjected to an alumite treatment so as to form an aluminum oxide layer 55 having a thickness of at least 10 μm and a high resistance value. Thereby otaining the same effect as that obtained by the embodiment shown in FIG. 8.

Alternatively, the transfer roller 51 shown in FIG. 9 may be provided at its end portion region B with a high molecular resin layer having a high insulating property instead of the above mentioned aluminum oxide layer 55. In addition, the adhesive agent for adhering the electrically conductive pipe 53 and the electrically conductive resilient member 54 together may be selected such that a usual adhesive agent having a high insulating property is used at the end portion region B of the transfer roller 51 and that an electrically conductive adhesive agent containing a large amount of metal powders, such as silver powders or copper powders, is used at the center portion region A of the transfer roller 51.

Experimental tests have demonstrated that it is preferable to set the resistance value of the electrically conductive member 54 in the range of about $10^5$ to $10^{12}$ [ohms] at the center portion of the transfer roller.

The length of the end portion region B and the thickness of the electrically conductive resilient member 54 are suitably selected such that the resistance value at the two end portions of the electrically conductive resilient member 54 is 3 times, preferably 10 times, higher than that of the center portion region A thereof.

As stated hereinbefore, if the transfer roller according to the invention is used for a multiple-copy electrophotographic apparatus, it is possible to effectively prevent the multiple-copy fog phenomenon and multiple-copy edge line phenomenon and obtain a plurality of copies each having good quality with a high transfer efficiency at a high speed.

In addition, the transfer roller according to the invention constructed as above described with reference to FIGS. 8 and 9 is capable of adhering the electrically conductive resilient member, which is uniform in quality and thickness, to the outer periphery of the electrically conductive roller shaft, thus, improving the adhesive property between the transfer roller shaft and the electrically conductive resilient member, and of preventing the occurrence of indentations on the surface of the electrically conductive resilient member.

Thus, this transfer roller is simple in construction and less expensive and is suitable for electrophotographic apparatus for obtaining a plurality of copies.

What is claimed is:

1. In a transfer roller for electrophotographic apparatus for transferring a toner image formed on a latent image electric charge holding body to a record sheet by making the record sheet closely contact with the latent image electric charge holding body, the improvement comprising:

an electrically conductive roller shaft connected to a transfer bias electric source and operative to apply a given transfer bias voltage between the roller shaft and the latent image electric charge holding body; and an electrically conductive resilient member coated around the outer periphery of the electrically conductive roller shaft, said resilient member having a constant outer diameter and having a resistance value which is increased toward the respective end faces at two end portions of the electrically conductive resilient member.

2. The transfer roller according to claim 1, wherein those portions of said electrically conductive roller shaft which correspond to two end portions of said electrically conductive resilient member are made smaller in diameter than the diameter of the center portion of said electrically conductive roller shaft.

3. The transfer roller according to claim 1, wherein the axial length of said electrically conductive resilient member is substantially equal to or shorter than the length of said latent image electric charge holding body.

4. The transfer roller according to claim 3, wherein two end face edges of said electrically conductive resilient member are planed off.

5. The transfer roller according to claim 1, wherein a high insulating member is interposed between two end portions of said electrically conductive resilient member and respective opposed portions of said electrically conductive roller shaft.

6. The transfer roller according to claim 1, wherein said electrically conductive resilient member is formed by electrically conductive resilient materials whose resistance values are different from each other such that the resistance value at the two end portions of said electrically conductive resilient member is increased in a stepwise manner toward the respective end faces thereof.

7. The transfer roller according to claim 1, wherein the resistance value at the endface portion of said electrically conductive resilient member is made 3 to 10 times higher than that at the center portion thereof.

8. The transfer roller according to claim 1, wherein said electrically conductive resilient member is uniform in quality and in thickness.

9. The transfer roller according to claim 1, wherein said increase in resistance value is a continuous increase.

10. The transfer roller according to claim 1, wherein said increase in resistance value is a stepwise increase.

11. In a transfer roller for electrophotographic apparatus for transferring a toner image formed on latent image electric charge holding body to a record sheet by making the record sheet closely contact the latent image electric charge holding body, the improvement comprising:

an electrically conductive roller shaft connected to a transfer bias electric source operative to apply a given transfer bias voltage between the roller shaft and the latent image electric charge holding body; and an electrically conductive resilient member coated around the outer periphery of the electrically conductive roller shaft, said resilient member having a resistance value which is increased towards the respective end faces at two end portions of the electrically conductive resilient member, wherein those end portions of said electrically conductive roller shaft which correspond to two end portions of said electrically conductive resilient member are made smaller in diameter than the diameter of the central portion of the electrically conductive roller shaft.

12. In a transfer roller for electrophotographic apparatus for transferring a toner image formed on latent image electric charge holding body to a record sheet by making the record sheet closely contact the latent image electric charge holding body, the improvement comprising:

an electrically conductive roller shaft connected to a transfer bias electric source operative to apply a given transfer bias voltage between the roller shaft and the latent image electric charge holding body; and an electrically conductive resilient member coated around the outer periphery of the electrically conductive roller shaft, said resilient member having a resistance value which is increased towards the respective end faces at two end portions of the electrically conductive resilient member, wherein the axial length of said electrically conductive resilient member is substantially equal to or shorter than the length of said latent image electric charge holding body, and wherein two end face edges of said electrically conductive resilient member are planed off.

13. In a transfer roller for electrophotographic apparatus for transferring a toner image formed on latent image electric charge holding body to a record sheet by making the record sheet closely contact the latent image electric charge holding body, the improvement comprising:

an electrically conductive roller shaft connected to a transfer bias electric source operative to apply a given transfer bias voltage between the roller shaft and the latent image electric charge holding body; and an electrically conductive resilient member coated around the outer periphery of the electrically conductive roller shaft, said resilient member having a resistance value which is increased towards the respective end faces at two end portions of the electrically conductive resilient member, wherein a high insulating member is interposed between two end portions of said electrically conductive resilient member and respective opposed portions of said electrically conductive roller shaft.

14. In a transfer roller for electrophotographic apparatus for transferring a toner image formed on latent image electric charge holding body to a record sheet by making the record sheet closely contact the latent image electric charge holding body, the improvement comprising:

an electrically conductive roller shaft connected to a transfer bias electric source operative to apply a given transfer bias voltage between the roller shaft and the latent image electric charge holding body; and an electrically conductive resilient member coated around the outer periphery of the electrically conductive roller shaft, said resilient member having a resistance value which is increased towards the respective end faces at two end portions of the electrically conductive resilient member, wherein said electrically conductive resilient member is formed by electrically conductive resilient materials whose resistance values are different from each other such that the resistance value at the two end portions of said electrically conductive resilient member is increased in a step wise manner toward the respective end faces thereof.

15. In a transfer roller for electrophotographic apparatus for transferring a toner image formed on latent image electric charge holding body to a record sheet by making the record sheet closely contact the latent image electric charge holding body, the improvement comprising:

an electrically conductive roller shaft connected to a transfer bias electric source operative to apply a given transfer bias voltage between the roller shaft and the latent image electric charge holding body; and an electrically conductive resilient member coated around the outer periphery of the electrically conductive roller shaft, said resilient member having a resistance value which is increased towards the respective end faces at two end portions of the electrically conductive resilient member, wherein the resistance value at the end face portion of said electrically conductive resilient member is made three to ten times higher than that at the center portion thereof.

16. In a transfer roller for electrophotographic apparatus for transferring a toner image formed on latent image electric charge holding body to a record sheet by making the record sheet closely contact the latent image electric charge holding body, the improvement comprising:

an electrically conductive roller shaft connected to a transfer bias electric source operative to apply a given transfer bias voltage between the roller shaft and the latent image electric charge holding body; and an electrically conductive resilient member coated around the outer periphery of the electrically conductive roller shaft, said resilient member having a resistance value which is increased towards the respective end faces at two end portions of the electrically conductive resilient member, wherein said increase in resistance valve is a continuous increase.

* * * * *